United States Patent [19]

Allen, Jr. et al.

[11] 3,935,596

[45] Feb. 3, 1976

[54] SURGICAL GOWN WITH TRANSFER DEVICE

[75] Inventors: Douglas Allen, Jr., Somerset; Richard F. Caffrey, Gladstone; J. Philip Scanlon, Lawrenceville, all of N.J.

[73] Assignee: Johnson & Johnson, New Brunswick, N.J.

[22] Filed: Nov. 6, 1974

[21] Appl. No.: 521,431

[52] U.S. Cl. ..... 2/114

[51] Int. Cl.[2] ..... A41D 13/00; A41B 9/00

[58] Field of Search ..... 2/74, 114, 69.5, 93, 154, 2/DIG. 2, DIG. 7, 300, 338; 206/46 AP, 63.2; 128/156, 157, 159

[56] References Cited

UNITED STATES PATENTS

| | | | |
|---|---|---|---|
| 3,359,569 | 12/1967 | Rotanz et al. | 2/114 |
| 3,594,818 | 7/1971 | Planner | 2/114 |
| 3,648,290 | 3/1972 | Hartigan | 2/114 |
| 3,754,284 | 8/1973 | Hartigan et al. | 2/114 |
| 3,803,640 | 4/1974 | Ericson | 2/114 |
| 3,824,625 | 7/1974 | Green | 2/114 |

*Primary Examiner*—Geo. V. Larkin

[57] ABSTRACT

A surgical gown having a central and side portions (hereinafter referred to as panels) and outer belt means. The belt means comprises two tie strings or the like, one of said ties being attached to the central panel of the gown near one of the two side panels. The other tie is attached to the second of the side panels near the outer edge thereof. The free end of each tie is releasably grasped by a transfer device which holds the ties in a position overlying the outer surface of the central panel. During the gowning procedure, the transfer device becomes the means whereby a sterile assistant may effect final closure of the gown without becoming contaminated or whereby a non-sterile assistant may effect final closure of the gown without endangering or destroying the sterile character of the gown. Preferably the gown also comprises inner closure means for further securing the gown in the waist area.

19 Claims, 21 Drawing Figures

SURGICAL GOWN WITH TRANSFER DEVICE

This invention relates to belted surgical gowns and, more particularly, to belted surgical gowns having means for holding the belt in a desired position prior to use and for facilitating the aseptic closing of the gown.

Sterile surgical gowns are worn by surgeons and other operating room personnel to prevent contamination of the patient, surgical instruments, operating room equipment, and other personnel by contact with the underclothes and/or body surfaces of the wearer. Additionally, surgical gowns serve to protect the wearer from undesired contact with blood, wound exudates, and similar fluids encountered during surgical procedures.

Surgical gowns, whether made from woven or non-woven materials, comprise a main sheet having sleeves affixed thereto. The main sheet comprises a central panel and two side panels, the latter frequently being of sufficient width to provide for a greater or lesser degree of overlapping when the gown is worn. The gowns are provided with closure means for securing the side panels in their appropriate abutting or overlapping relationship when the gown is being worn. Most, if not all, surgical gowns, carry such closure means in the neck region and quite frequently closure means are provided in the waist regions, also. Gowns of the prior art also have belt means, distinct from the aforementioned closure means, whose purpose is to ensure that the gown fits the wearer snugly in the waist area. Such belt means may comprise a single strip of narrow width material of sufficient length to pass around the body. Alternatively, such belt means may comprise two tie strings, one end of each tie string being affixed to the main sheet. The free ends of the tie strings are tied together by the wearer around his waist after he has preliminarily adjusted their tension to suit his own liking. The sleeves are full length and may have cuffs. The gowns are usually "full length," that is, they extend from the neck region to the wearer's knees.

Surgical gowns having the general structure just described may be donned by the wearer in two ways. The gown may be donned with the central panel of the main sheet overlying the front of the wearer's body, in which case the side panels of the main sheet cover his back. When worn in this fashion, the gown is closed in the back and is referred to as a "back-closing" gown. Alternatively, the gown may be donned so that the central panel covers the back, and the side panels cover the front, of the wearer's body. In this case, the gown would be closed in the front and would be designated a "front-closing" gown. For reasons of ease of preservation of asepsis, and general convenience and practicability, the back closing surgical gown is greatly preferred in the modern operating room and hence most commercially available surgical gowns are of this type.

In preparing for surgery, the surgeon first thoroughly scrubs his hands and arms for an extended period of time. He must next put on his sterile surgical gown. The surgeon must put on his gown aseptically, that is, he must use a gowning procedure which will both insure that the sterile character of the gown, or at least the sterile character of the surfaces thereof which will face the patient and operating table, will be preserved and that the surgeon himself will not contact surfaces that are in fact contaminated or which are deemed to be contaminated.

The surgeon is unable, for all practical purposes, to completely and aseptically don a back closing surgical gown without the assistance of another person. One reason for this is that, under presently accepted concepts of sterile technique, it is not permissible for the surgeon to place his hands and/or arms behind his body to close the gown. To do so presents a very real danger of contamination of the surgeon's hands or arms by accidental contact with, for example, his scrub suit or a piece of operating room equipment. Thus, regardless of whether the surgeon actually contacts such clothing or equipment, he is deemed to have contaminated his hands and arms if they should for any reason extend past the respective sides of his body toward the back thereof.

In view of the above considerations, it is clear that a surgeon must have the assistance of a second person in order to aseptically don his surgical gown. There are two classes of personnel available in the operating room to provide such assistance. Members of the first of these classes are generally referred to as "non-sterile" persons. A non-sterile person is one who has not been through a standard scrubbing procedure prior to entering the operating theater. Thus any item contacted, or at least the portion thereof contacted, by a non-sterile person is thereafter contaminated (or is deemed to be contaminated). Typically, the circulating nurse in the operating room is non-sterile. Other personnel, typified by the scrub nurse (and, of course, the surgeons and their operating assistants), are "sterile" persons. A sterile person is one who has undergone a standard scrubbing procedure in preparation for the operation and who is suitably outfitted, e.g., with a gown, gloves, head and face coverings and the like to insure against subsequent contamination.

The side panels of a back closing surgical gown protect the sides and back of the wearer. In some gown designs, the edges of the side panels just meet on the back; in other designs the panels are sufficiently wide enough to provide for a degree of overlap. In either case, the side panels have some sort of cooperating closure means, such as snaps, Velcro fasteners, strings or the like which must be engaged in order to close the gown and insure that it will stay in place on the wearer during surgery. As indicated earlier, such closure means are frequently placed on the gown in the neck and waist region. For the reasons given earlier, it is not permissible for the surgeon to partially don his gown and then attempt to reach behind his back in order to affect closure.

Thus it is seen that the use of a back closing surgical gown by the surgeon requires that a second person be available to effect closure of the gown. Under presently accepted principles of sterile technique, it is not permissible for a sterile person to effect the required closure. Again, this is because there is a grave risk present that the sterile person will be contaminated by accidentally touching the hair or neck or scrub suit of the surgeon when trying to engage the closure means in the neck region. Similarly, there is danger of contacting the scrub suit, with the same undesirable results, if there are closures in the waist region. Inasmuch as closure of the gown cannot be safely effected by either the surgeon himself or by a sterile assistant the practice in modern hospitals is to have a non-sterile person, e.g., the circulating nurse, effect closing of the surgical gown in the back. Since this closing of the gown is done by a non-sterile person, the back of the gown is thereafter deemed to be contaminated, and this is true even where the non-sterile person, e.g., resorts to a method such as the use of sterile forceps in an effort to aseptically close the gown.

As indicated earlier, surgical gowns are frequently provided with belt means for securing the gown snugly at the waist. Such belt means usually overlie the outer front surface of the gown, that is, the surface of the gown which will face, and possibly come into contact with, the patient, operating table, instruments and the like. It is absolutely essential, of course, that all structural elements comprising the outer front portion of the gown be preserved in their sterilized condition. Any help required by the surgeon in adjusting and/or closing the aforementioned belting means must be provided by a sterile person or by a non-sterile person using a method that will not endanger the sterility of the outer front of the gown. If help is to be provided by a sterile person, any danger of contaminating that person must be eliminated. In order to preserve his own sterile condition and that of the outer front surface of the gown while assisting in the final closure step, the sterile assistant, therefore, may contact only those portions of the gown which are in a sterile condition. If the surgeon is to be helped by a non-sterile assistant, the structure of the gown must be such that the help can be provided without the danger of destroying the integrity of the sterile portions of the gown.

One of the surgical gowns provided by the prior art is a back-closing gown comprising a main portion having a central and two side panels. This gown has inner closure means comprising two tie strings. One of the ties is attached to the inner surface of the gown at waist level near the line at which the right side panel joins the main panels. The other tie string is attached to the outer edge of the left side panel. The gown also has a belt means which, when the gown is completely donned, encircles the body of the wearer at waist level. This belt means comprises a relatively short tie string secured to the outer front surface of the gown at waist level and along the line at which the right hand panel joins the main panel, and a longer tie string attached near the outer edge of the right hand panel. This latter tie has a "pull-off" tape at its free end and is folded into a compact condition so that the pull-off tape may be readily grasped by an assistant.

After the surgeon has put his hands through the sleeves of the gown, the circulating nurse steps behind the surgeon, grasps the tie strings comprising the inner closure, pulls them together, and knots them. The circulating nurse then grasps the tie string carrying the "pull-off" tape, walks around the back of the surgeon to the front. This action brings the right side panel into a position overlapping the outer surface off the left side panel and puts the end of the tie string in a waist level position in front of the surgeon. The surgeon grasps the tie with his left hand and the circulating nurse tugs on the pull-off tape to release it from the end of the tie string. The surgeon then grasps the second tie string comprising the belt means in his right hand and ties the strings into a knot. Such a gown has two major disadvantages. The first disadvantage is that the tie string with the pull-off tape can be handled only by a circulating, i.e., non-sterile, nurse. This is because the pull-off tape associated with this particular tie string is positioned in such a way that there is a great danger that a person reaching for it would be quite likely to contact the surgeon's scrub suit, a contaminated area. Thus it is not permissible, under presently accepted principles of sterile technique, for a sterile person, e.g., the scrub nurse, to handle the tie string under these circumstances. The second major disadvantage resides in the fact that, after the tie strings comprising the belt means have been knotted by the surgeon, the resulting knot inconveniently overlies the central portion of the outer surface of the main panel of the gown. This position of the knot may be uncomfortable to the wearer, and may also interfere with the surgical procedure.

Another back closing gown provided by the prior art also comprises a main body portion also having central and side panels. This gown has inner closure means similar in construction, positioning, and operation to the first mentioned prior art drape. The belt means provided with this gown comprises a single length of narrow width material sufficiently long to encircle the wearer's body at waist level. The belt is folded for compactness and is held on the outer surface of one side of the gown by holding means comprising a widened loop of material. A portion of a first end of the belt projects from the holding means toward the front of the wearer. A portion of the second end of the belt is covered with a small disposable rectangular bag and projects toward the rear of the gown. In use, the circulating nurse grasps the bag covering the second end of the belt and walks around behind the surgeon. The surgeon grasps the sterile portion of the belt with his left hand, being careful not to touch the disposable bag, and the nurse pulls the disposable bag away. The surgeon grasps the first end of the belt in his right hand, pulls it free from the holding means and ties the free ends in a knot. The disadvantages of this prior art gown are substantially the same as those associated with the first described prior art gown, that is, the surgeon can be assisted in the final stages of positioning and securing the belting means by a non-sterile person only and the final knot disadvantageously overlies the central part of the outer surface of the front of the gown.

Thus it is seen that with the aforementioned prior art gowns, only a non-sterile person such as the circulating nurse may assist the surgeon in donning and closing his surgical gown. This is inconvenient and wasteful of time in that the circulating nurse may be occupied with other duties when the surgeon requires her assistance.

In accordance with the present invention the above mentioned and related problems associated with the prior art gowns are avoided by providing a surgical gown which comprises inner closure means for initially securing the gown in place on the wearer and belt means for securing the gown snugly at the waist. Our new gown has a belt means comprising two tie strings the first ends of which are secured to the gown and the second ends of which are releasably secured to, or grasped by, a belt engaging means (hereinafter called a "transfer device"). The transfer device holds the tie strings comprising the belt means in a position overlying the outer surface of the main panel of the gown prior to use and during the initial steps of the gowning procedure. Thereafter, the transfer device is used to aseptically transfer the belt means back and forth between the wearer and his assistant whereby the aseptic donning and closing of the gown is greatly facilitated. In accordance with the present invention, it is possible for either a sterile or a non-sterile person to assist the wearer in placing and securing the belt means and this assistance may be easily rendered without destroying or endangering asepsis. The belt means is constructed and arranged so that there is no knot overlying the central panel of the drape; this arrangement eliminates the inconvenience of having a centrally located knot which, among other things, may interfere with the surgical procedure.

As will be seen, the use of the transfer device on the gown of the present invention also prevents the belt means from accidentally falling below waist level (in which case the belt is deemed to have been contaminated).

In a modification of the present invention, the transfer device may be color coded so that the surgeon and his assistant may quickly recognize which structural elements to grasp during the several steps of the gowning procedure.

Surgical gowns in accordance with the present invention are easily folded into a compact unit which may be suitably packaged and subjected to any of the sterilization procedures well known in the art.

BRIEF DESCRIPTION OF THE DRAWINGS

The aforementioned and other advantages of the present invention will become apparent upon reading the following detailed description and upon reference to the appended drawings in which.

DETAILED DESCRIPTION OF THE INVENTION

While the invention will be described in connection with its preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
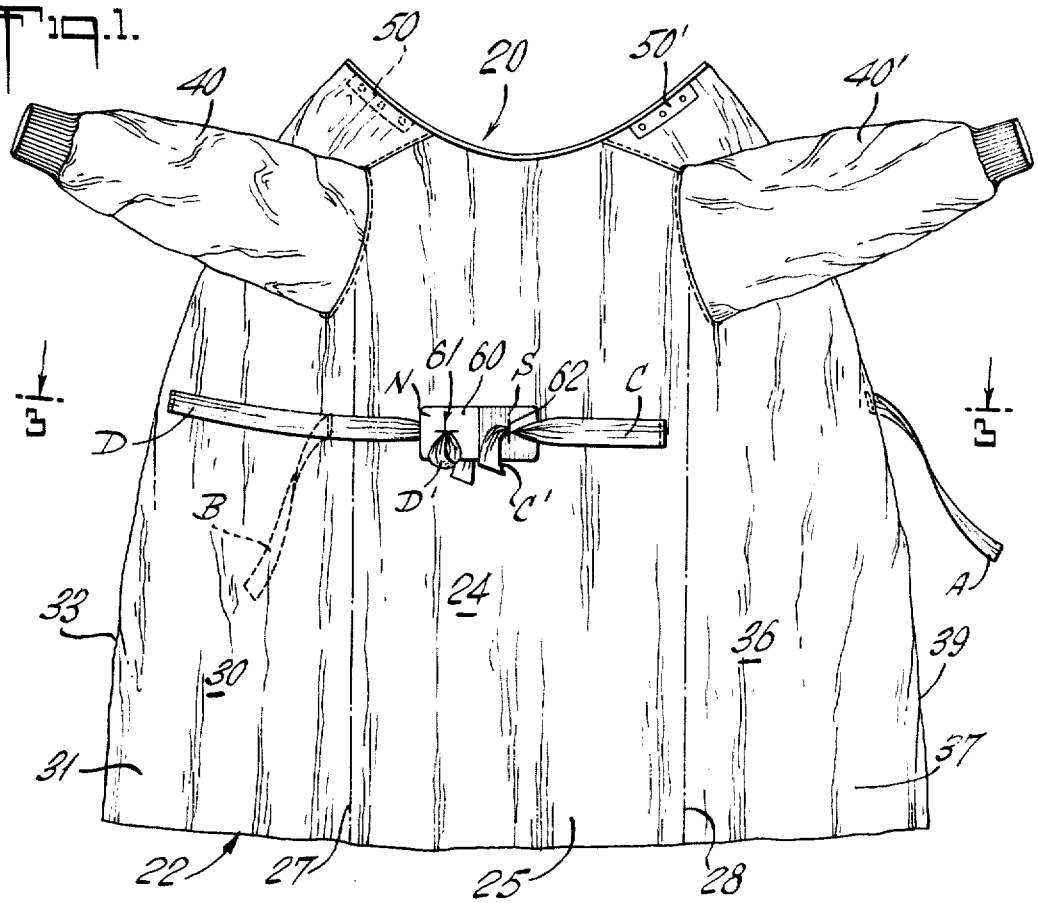
FIG. 1 is a front elevational view of a surgical gown in accordance with the present invention showing tie strings C and D comprising the outer belt means being held in place by the transfer device.
Figure 2:
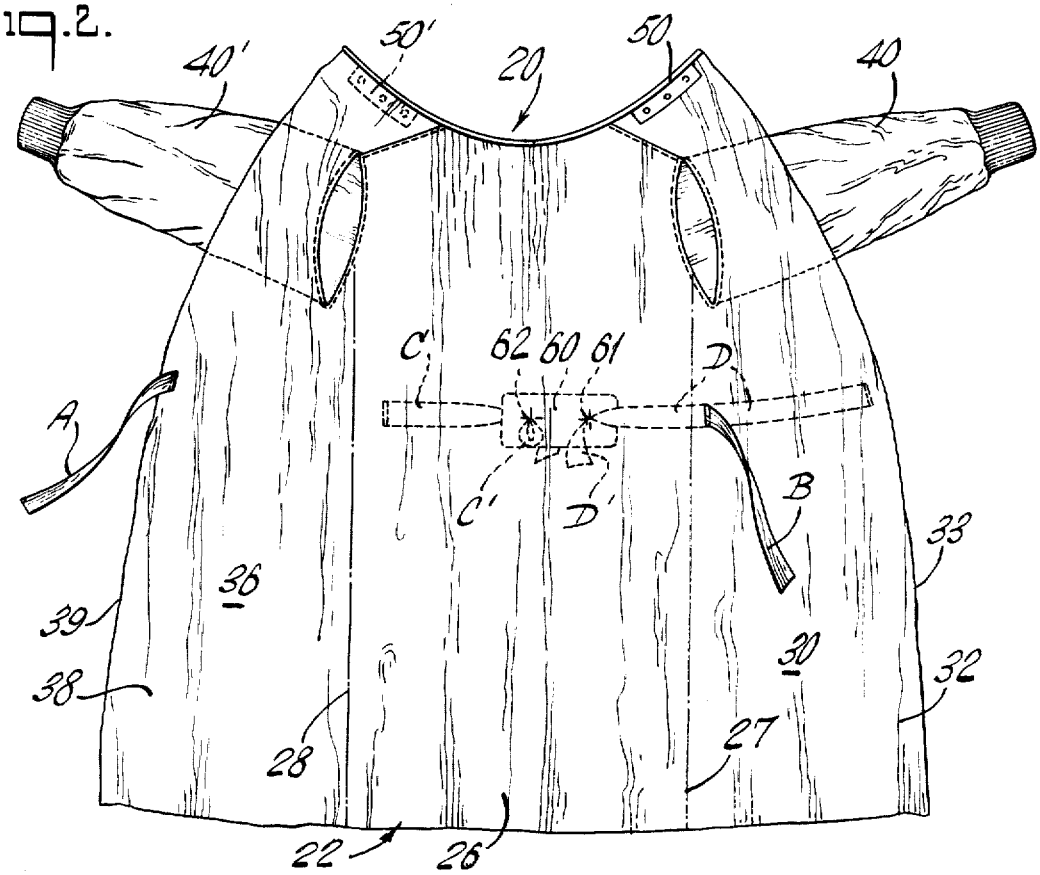
FIG. 2 is a rear elevational view showing the inner surface of the gown of FIG. 1.
Figure 3:
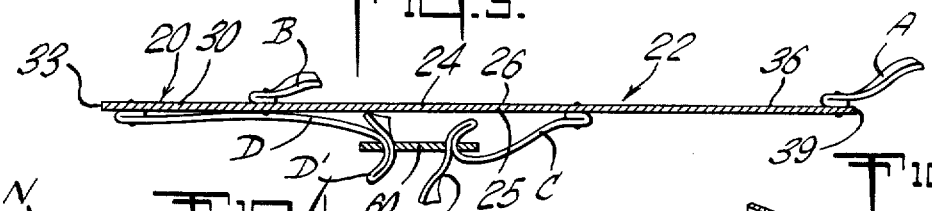
FIG. 3 is a cross-sectional view taken along line 3—3 of FIG. 1.

Referring particularly to FIG. 1–3 there is shown a back closing surgical gown in accordance with the present invention. Gown 20 comprises a main sheet 22 which has a central panel 24, a first side panel 30, and a second side panel 36. Central panel 24 has an outer surface 25 and an inner surface 26. Side panels 30 and 36 have outer surfaces 31 and 37, inner surfaces 32 and 38, and outer longitudinal edges 33 and 39, respectively.

In the preferred embodiment, the main sheet is made from a single piece of flexible drapable material such as a woven or nonwoven fabric. For purposes of convenience in describing the gown, FIGS. 1 and 2 show side panel 30 joining central panel 24 along dot and dash line 27 and side panel 36 joining the central panel along dot and dash line 28. It will be understood that central panel 24 is generally wide enough to cover the front of the wearer's body from one side thereof to the other. The side panels are of sufficient width to extend from the sides of the body and to overlap in the back. Thus when the gown is worn, line 28 would be adjacent the left side of the wearer's body and line 27 would be adjacent the right side of the body. It will be recognized that the central and side panels could be individual pieces of material joined, e.g., by stitching, along lines 27 and 28. The gown is long enough to extend from the neck to approximately the knees of the wearer.

The gown has cuffed sleeves 40, 40' which are attached to appropriate openings in the main sheet and cooperating snap fasteners 50, 50' which are attached near the upper edges of the outer surfaces of the side panels. The purpose of the snap fasteners is to close the gown in the neck region. Other fastening means, e.g., Velcro fasteners or tie tapes, may be used, if desired, in place of the cooperating snaps.

The gown has an inner closure means whose purpose is to draw the gown snugly around the wearer's waist to avoid "gapping" in the upper back area. Preferably, the inner closure means comprises two cooperating tie strings A, B. Tie string A is secured, at approximately waist level, to second side panel 36 near its outer edge 39. Tie A may be attached to either the inner or outer surface of panel 36, the inner surface being preferred for this purpose. Tie B is attached to the inner surface of the drape, also at approximately waist level, at or near that part of the gown at which first side panel 30 joins main panel 24, i.e., hear line 27. Other inner closure means, e.g., Velcro fasteners or co-operating snaps, could be used, if desired.

The outer belt means also comprise two cooperating tie strings, C, D. Tie C is attached, at approximately waist level, to the outer surface of the gown at or near that part of the gown where the second side panel 36 joins the main panel (i.e., at or near line 28). Tie D is attached, at about waist level, to first side panel 30 at or near side edge 33 thereof. This attachment of tie D may be made on either the inner or outer surface of side panel 30, the outer surface, however, being preferred. All tie strings are conveniently secured to the gown by way of stitching, although any other suitable securing means well known to those in the art may be used.

Central panel 24 and side panels 30 and 36 may be constructed of any flexible, drapable material, such as plastic or a woven or nonwoven fabric. In order to provide for comfort, economy, and disposability after a single use, the gown is preferably made from a nonwoven fabric. Most preferably the main panel and side panels comprise a liquid repellent nonwoven. The tie strings may be made from any suitable material, such as cotton tapes or a nonwoven fabric. Ties made from nonwoven fabric in strips about 1 – 2 inches wide have been found quite satisfactory for this purpose.

In order to keep the tie strings comprising the outer closure means in a fixed position until the gown is ready for use and to provide means which make it possible to aseptically handle and don the gown, there is provided in accordance with the teachings of the present invention a belt engaging means (hereinafter called a "transfer device").

As will be recognized upon a further reading of this specification, the transfer device may assume various sizes and shapes and may be made from a variety of raw materials, such as, for example, paperboard or plastic, so long as those materials are non-toxic, are capable of being sterilized, and are otherwise acceptable for use in the operating room. The transfer device serves several purposes. Prior to actual use, the transfer device holds the free ends of the tie strings comprising the outer belt means in a position, preferably at waist level, overlying the outer surface of the central panel of the gown. Thus, when the gown is unfolded prior to being put on by the surgeon, there will be no danger of the tie strings falling to the floor and the tie strings will be in a position where they are easily and readily accessible to the surgeon and/or his assistant. The transfer device must be adapted to releasably grasp the ends of the tie strings and release them in a selected sequence. When these requirements are met, the transfer device becomes the implement by which the tie strings are sequentially and aseptically handled during the final stages of the gowning procedure. Finally, the transfer device should be removable from the gown so it may be discarded.

Figure 4:
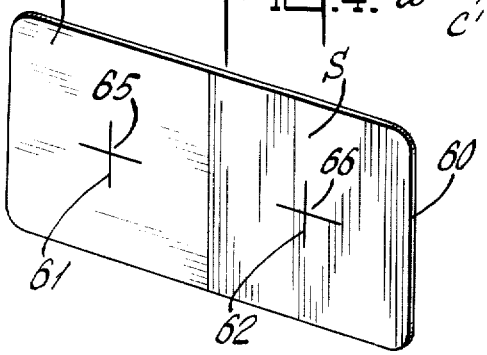
FIG. 4 is a perspective view of the transfer device used with the gown of FIG. 1.

The transfer device shown in the FIGS. 1–4 meets the above mentioned requirements. Transfer device 60 comprises a generally rectangular element made from cardboard which is sufficiently sturdy to resist bending and folding in the circumstances under which it is used. Referring especially to FIG. 4, transfer device 60 comprises a piece of paperboard, 24 mils thick and about 5-½ inches long by 3 inches wide. The paperboard has a basis weight of about 225 pounds per ream.

Figure 4A:
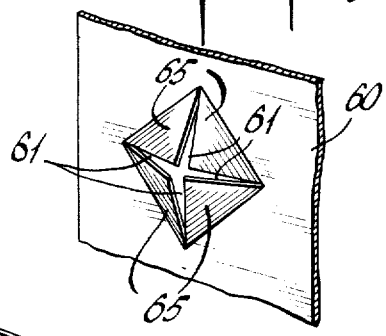
FIG. 4*a* is an enlarged fragmentary view of a portion of the transfer device of FIG. 4 showing the prong-like, grasping elements of the transfer device.

As illustrated in FIGS. 4 and 4a, transfer device 60 has two cross-shaped slits 61, 62 spaced about 2-½ inches apart on a center to center basis. These slits, which are cut completely through the thickness of the transfer device, define prong-like elements 65 and 66, respectively. These prong-like elements, which have a certain degree of flexibility or "give" associated with them, have been found to be capable of releasably grasping ties C, D. Thus, during manufacture, end portion D′ of tie D is threaded through slit 61 whereupon it is releasably grasped by prongs 65. Similarly end portion C′ of tie C is threaded through slit 62 where it is releasably grasped by prongs 66. Until the gown is actually ready to be used, the respective ends of ties C and D are thus secured in a position overlying the outer surface of main panel 24, this arrangement preventing the ties from accidentally falling toward the floor when the gown is being put on.

Figure 15:
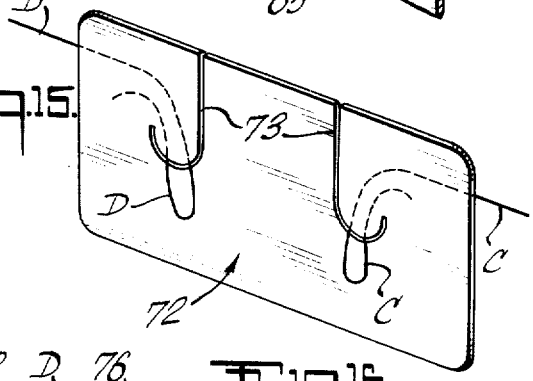
FIGS. 15–17 shows various alternative embodiments of the transfer device of this invention.
Figure 16:
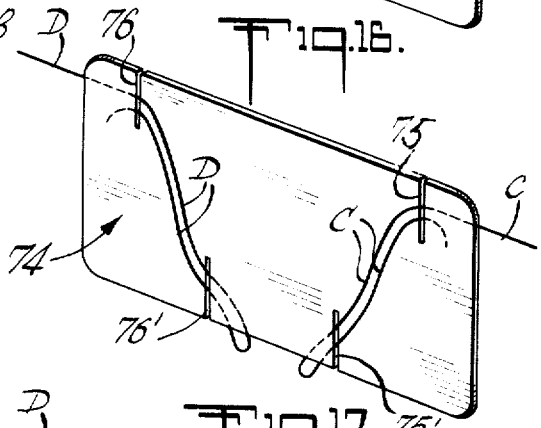
Figure 14:
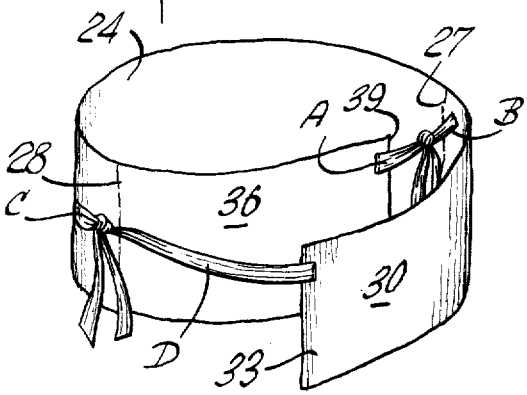
FIG. 14 is a diagrammatic rear perspective similar to FIG. 13 and showing the outer belt means fastened at the left side of the wearer's body.
Figure 17:
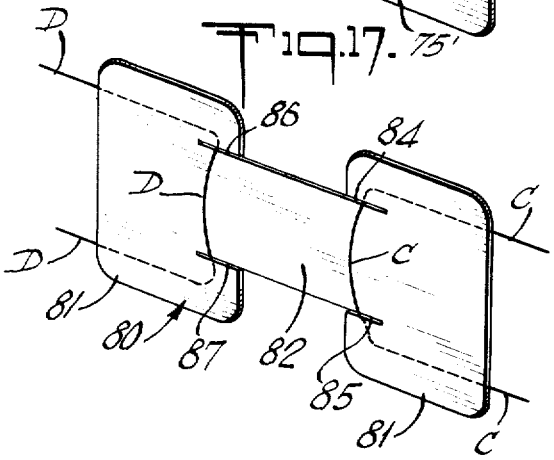

FIGS. 15, 16 and 17 illustrate other transfer devices that have been found suitable for use in practicing the present invention. In FIG. 15, transfer device 72 has hook-shaped slits 73 cut therethrough. Ties C and D can be easily threaded through the slits during assembly of the gown and are readily releasable from the transfer device at the appropriate stage of the gowning procedure. Transfer device 74, illustrated in FIG. 16, has four slits. Slits 75 and 76 are positioned near the ends of the transfer device and run inwardly from the top edge thereof. Slits 75′ and 76′ are more centrally positioned and run inwardly from the bottom edge of the transfer device. Tie string C is threaded through slit 75 from the back of the transfer device toward the front and then through slit 75′ from the front to the back. Tie string D is threaded in the same way through slits 76, 76′. This arrangement of the tie strings on the transfer device is advantageous because it allows for positive control of the tie string release by the wearer when initially releasing and also when final release is effected by the wearer and assistant. FIG. 17 shows another transfer device 80 which is generally H-shaped and comprises rectangular end portions 81 joined by a cross-bar portion 82. Slits 84, 85, 86, and 87 are cut into portions 81 at the points where the latter are joined to cross-bar portion 82. Tie C is threaded behind device 80, through slit 84 from back to front, and then through slit 85 from front to back. Tie D is similarly threaded through slits 86 and 87.

It will be recognized that the free ends of the tie strings can be releasably held to the transfer device in other manners. For example, a transfer device comprising paperboard coated with a pressure sensitive adhesive will serve this purpose quite well.

Those skilled in the art will be able to design innumerable kinds of transfer devices that will releasably hold the tie strings. The embodiments described herein are for illustrative purposes and applicants are not limited in any way thereby.

ASSEMBLY AND FOLDING OF THE GOWN

The gown of the present invention is easily assembled by providing a main sheet of desired size and cutting armholes therein. The sleeves and neck closure means are attached, e.g., by sewing, to their appropriate places on the main sheet.

After the tie strings have been attached, the gown is prepared for folding, preferably as follows. Referring to FIG. 1, a portion of the free end of tie C is looped back upon itself and inserted, from front to back through one of the slits in transfer device 60. A looped portion of the free end of tie string D is then inserted, from back to front, through the other slit in the transfer device.

There are many ways in which the gown, prepared in the manner just described, can be folded into a compact unit. The folding should be such that, when the gown is picked up by the wearer, it will unfold to assume the general configuration shown in FIG. 1, after which it may be aseptically donned by the procedures described earlier herein.

Figure 18:
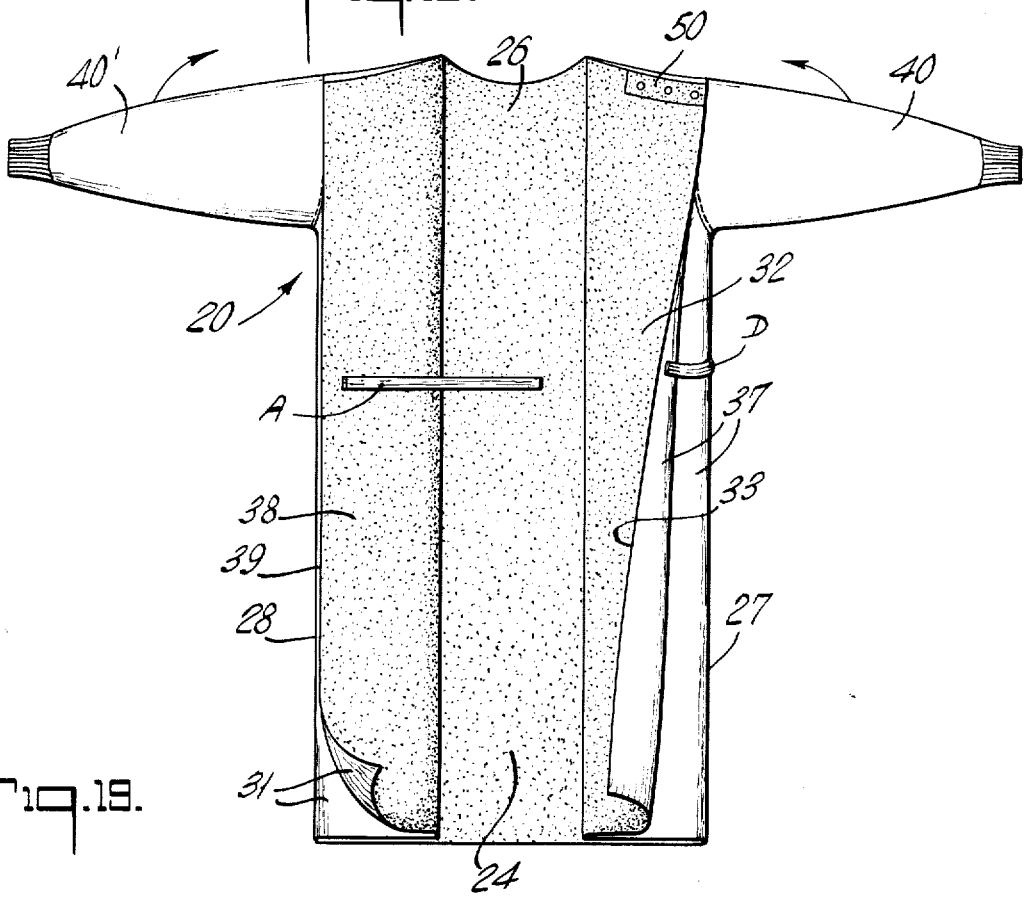
FIG. 18 is a rear elevational view showing the surgical gown in a partially folded configuration and with certain parts turned back for purposes of illustration.
Figure 19:
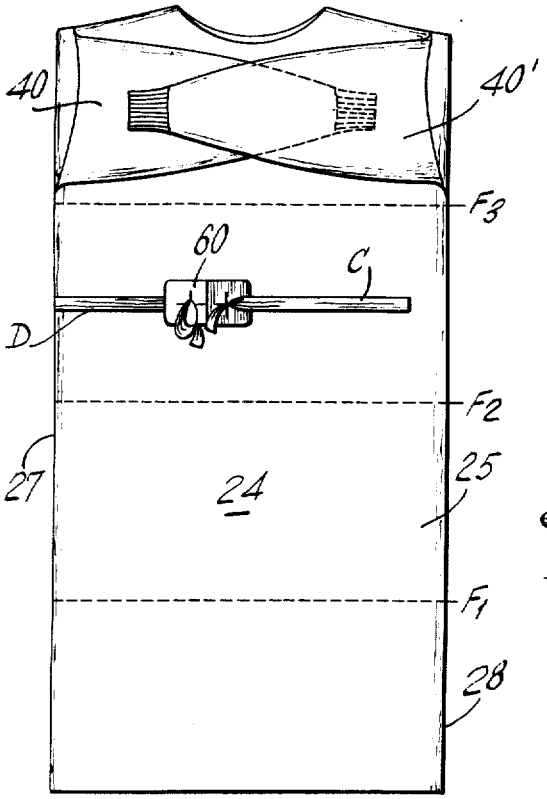
FIG. 19 is a front elevational view of the gown of FIG. 18 and showing the sleeves in their folded position and also showing the fold lines for the longitudinal folding of the gown.
Figure 20:
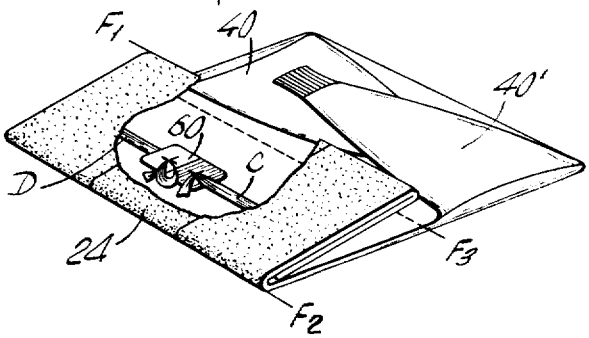
FIG. 20 is a perspective view, with parts broken away, showing the gown just prior to making the last fold.

The folding method disclosed in U.S. Pat. No. 3,359,569 has been found suitable for folding the gown of the present invention into a compactly folded unit. In FIGS. 18–20, inner surfaces are indicated by stippling and outer surfaces are left plain. FIG. 18 shows gown 20 placed on a flat surface in the configuration illustrated in FIG. 2, that is, with inner surface 26 of the central panel facing upwardly. Left hand panel 36 is folded along line 28 so that it overlies central panel 24. Half of panel 36 is then turned back upon itself, so that side edge 39 thereof is aligned vertically with line 28. Tie string A is disposed in a generally horizontal direction to overlie inner surface 38 of panel 36 and part of inner surface 26 of the central panel. Tie string B is placed in a generally vertical position adjacent line 27 and overlying inner surface 26 of the central panel. Right hand panel 30 is then folded along line 27, then back upon itself so that outer edge 33 is aligned vertically with line 27. The configuration of the gown at this stage is illustrated in FIG. 18. It will be understood that FIG. 18 illustrates panels 30 and 36 in a partly folded back position; this has been done to illustrate the location of tie string D at this stage of the folding.

The gown is carefully turned over and each sleeve is folded across the upper part of the gown. FIG. 19 shows the gown after it has been turned over and the sleeves have been folded, i.e., FIG. 19 shows outer surface 25 of central panel 24 with transfer device 60 and tie means C and D in place. FIG. 19 also shows transverse fold line $F_1$, $F_2$ and $F_3$. These fold lines are preferably placed so as to divide the gown vertically into 4 sections having substantially equal dimensions. The bottom part of the gown is then folded upwardly around fold line $F_1$ and upwardly again around fold line $F_2$. At this point the gown has assumed the folded configuration shown in FIG. 20. The folding sequence is completed by folding the uppermost portion of the gown around fold line $F_3$ so that the portion of the gown lying between the top edge thereof and fold line $F_3$ overlies the remaining portions of the gown. After the topmost portion of the gown has been folded the gown will have assumed the configuration illustrated in FIG. 5, that is, the gown will have pockets on its upper surfaces into which the wearer may place his hands at the outset of the gowning procedure.

After the gown has been folded as set forth above, it can be folded again, in the transverse direction, to provide a final compactly folded unit. The drape is then packaged, the package is sealed, and the packaged drape is subjected to any desired sterilization cycle.

DONNING OF THE GOWN

Figure 6:
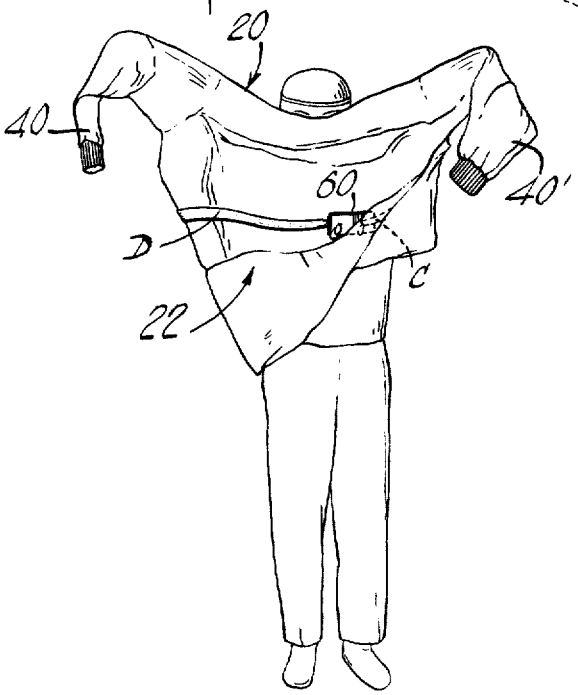
FIG. 6 shows the gown just as the surgeon is beginning to put his arms through the sleeves.
Figure 5:
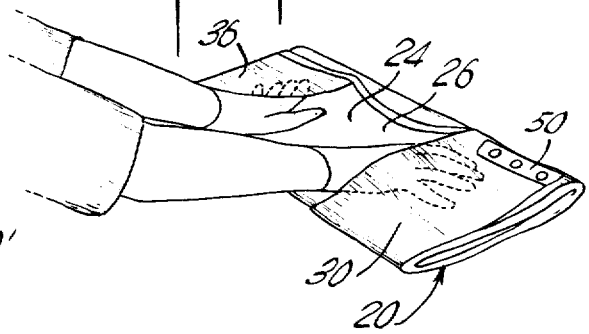
FIG. 5 is a perspective view showing the gown of FIG. 1 in a folded configuration and illustrating the positioning of the hands of the outset of the gowning procedure.

As illustrated in FIG. 5, the surgeon inserts his hands into the pockets on the top surface of the folded unit, these pockets having resulted from folding the gown in accordance with the above directions. The surgeon lifts the gown from its resting place and, at the same time he begins raising his arms to the position shown in FIG. 6, starts to insert his arms into the sleeves. FIG. 6 shows the surgeon with his arms partially inserted and with the gown beginning to fall into a completely unfolded position. The circulating nurse moves behind the surgeon, grasps folded side panels 30 and 36, and pulls them around behind the surgeon. The circulating nurse then grasps tie strings A and B, adjusts them to the surgeon's liking, and knots them together near the point where tie B is attached to panel 30.

Figure 13:
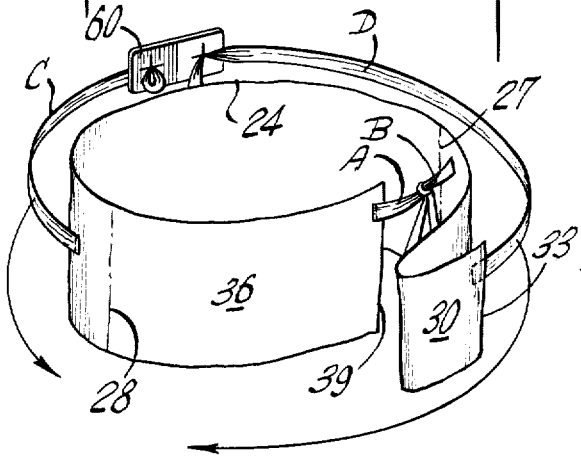
FIG. 13 is a diagrammatic rear perspective showing the overlapping of the side panels of the gown and illustrating how the left side panel is held in position with the inner closure means.
Figure 7:
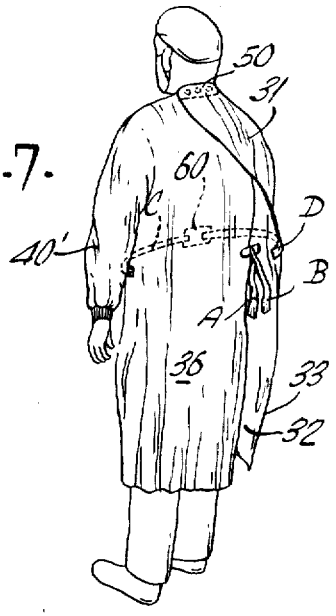
FIG. 7 is a rear perspective of the gown on the surgeon and showing the inner closure means fastened at the right side of the wearer's waist, and with the right side panel partially turned back.

The circulating nurse then grasps the upper part of panel 30, brings the edge thereof toward the surgeon's left, and fastens the neck closure. At this stage of the gowning procedure, the position of the gown on the surgeon is as illustrated in FIG. 7 and the relationship of the gown around the waist region of the wearer is as illustrated diagrammatically in FIG. 13.

This aforementioned stage of the gowning procedure having been completed, the surgeon may be assisted in the remaining steps by either the circulating nurse (non-sterile person) or the scrub nurse (sterile person). If the circulating nurse assists, this may be done without her contaminating the sterile surfaces of the gown. If it is desired that the scrub nurse assist at this stage, when this can be done without endangering her status as a sterile assistant. This is so because, even though the sterile nurse must pass behind the surgeon to provide the needed assistance, she can do so at a distance which will preclude any possibility of her contacting the back of the gown, which at this point is non-sterile or deemed to be so.

Figure 8:
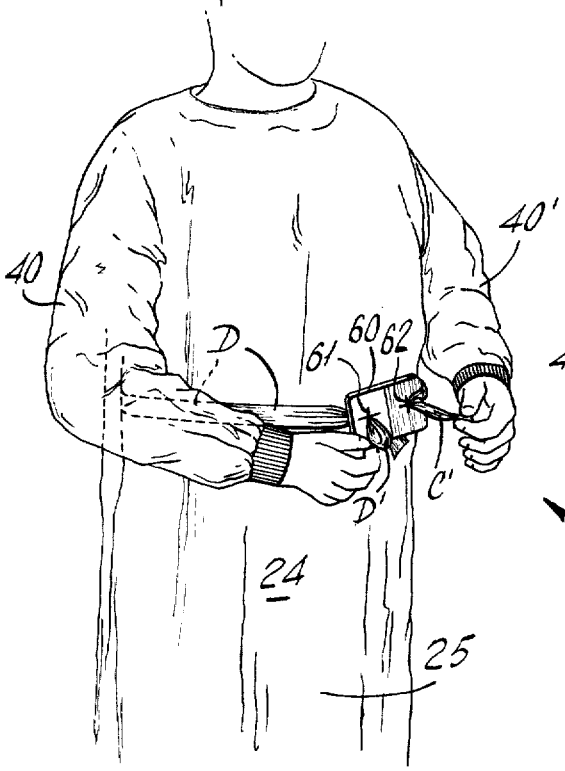
FIG. 8 is a front perspective showing the surgeon grasping the transfer device with his right hand and the end of tie string C in his left hand.
Figure 9:
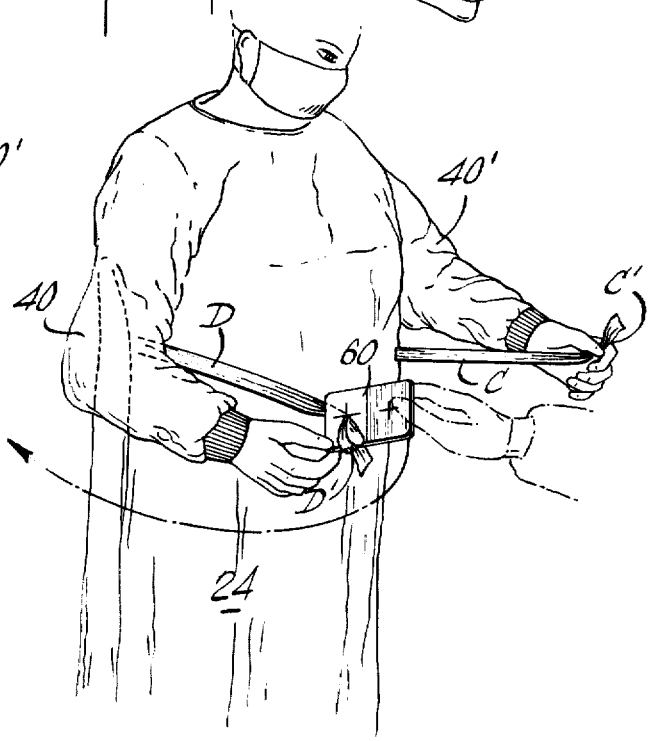
FIG. 9 is a perspective view showing the surgeon as he presents the transfer device to his assistant.

Returning now to the description of the gowning sequence, and referring particularly to FIGS. 8 and 9, the chosen assistant, either sterile or non-sterile, stands in front of the surgeon. The surgeon grasps the right hand side of transfer device 60 in his right hand and grasps the end of tie C in his left hand (FIG. 8). The surgeon then pulls tie C from transfer device 60 and offers the transfer device to his assistant (See FIG. 9). The assistant grasps the transfer device at the end thereof which is opposite to the end at which tie D is releasably held, being careful (if the assistant be the circulating nurse) not to touch tie D. The surgeon while continuing to hold tie C in his left hand, releases his grasp on the transfer device and moves his right arm out of the way.

Figure 10:
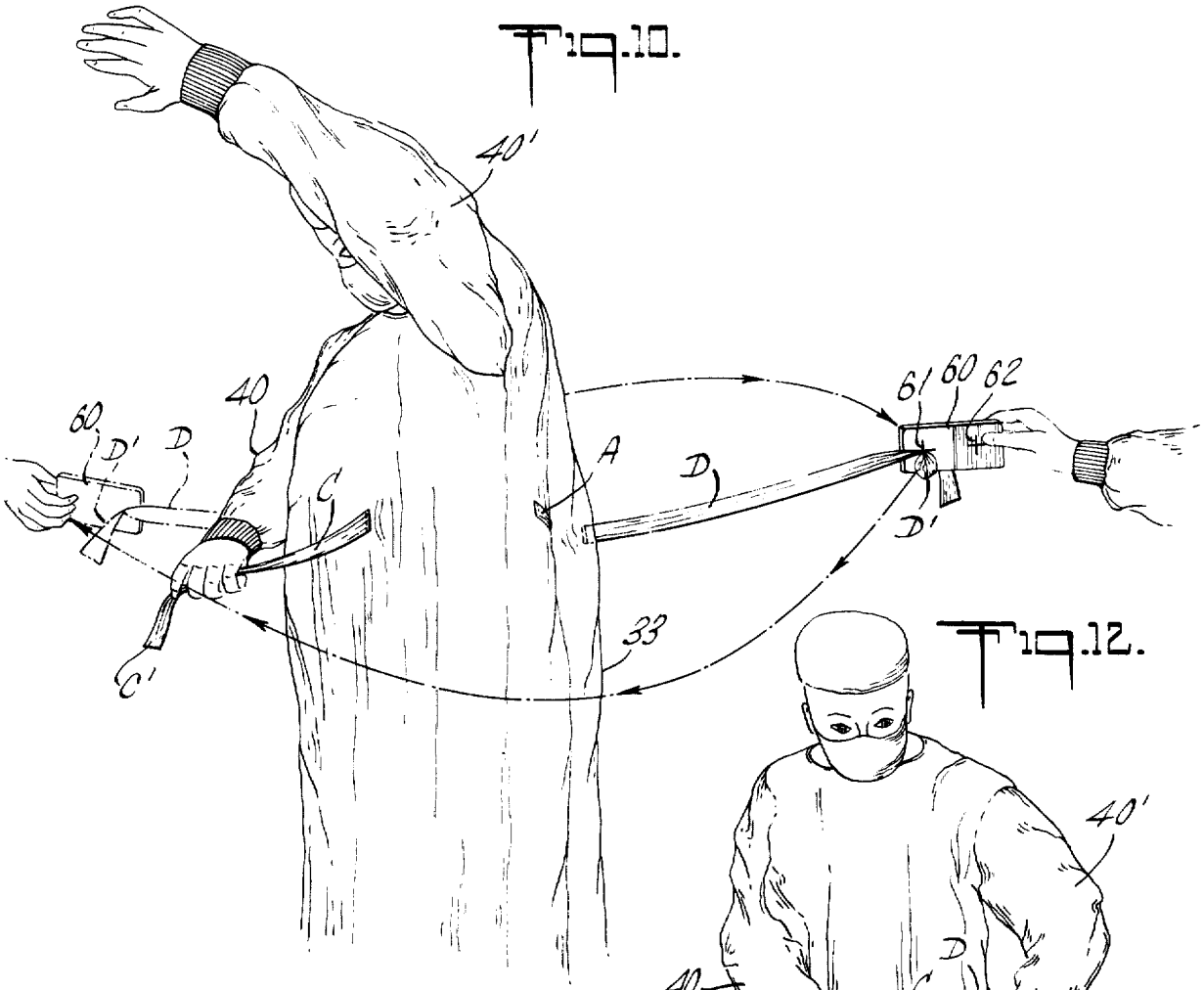
FIG. 10 is a perspective showing the assistant carrying the transfer device around behind the surgeon.
Figure 12:
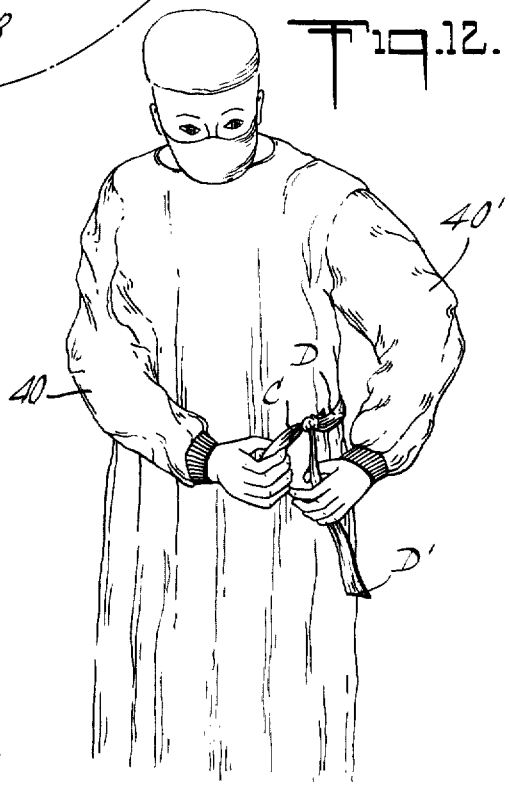
FIG. 12 shows the surgeon knotting tie strings C and D near the left side of his body.
Figure 11:
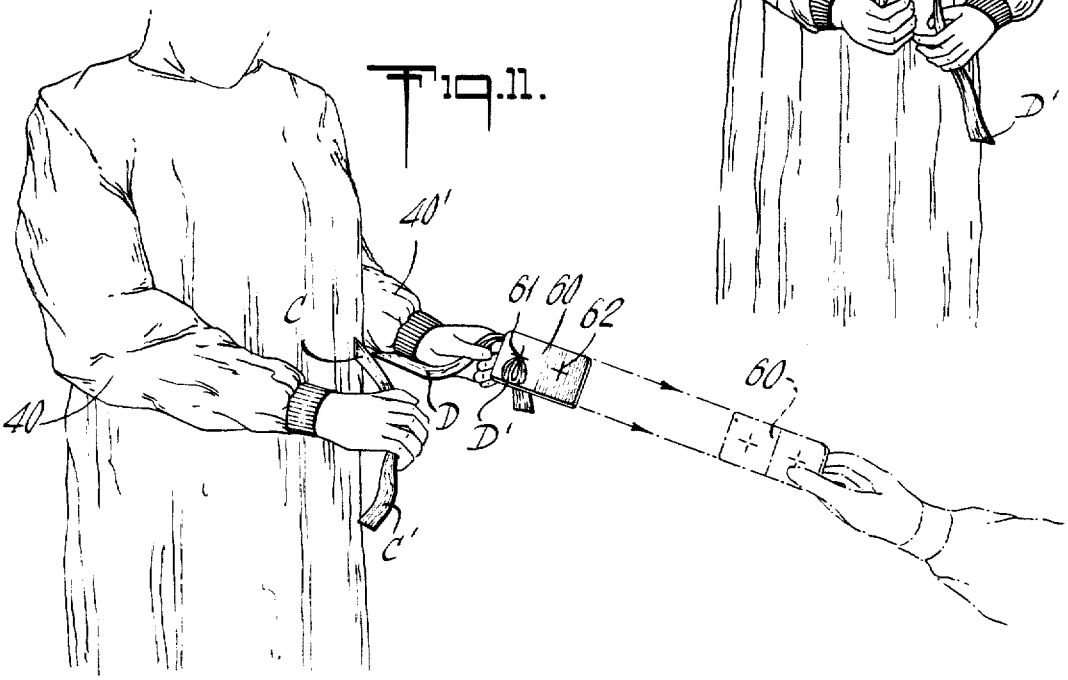
FIG. 11 is a perspective showing the surgeon grasping tie string D with his left hand and the assistant pulling on the transfer device to detach the end of the tie string therefrom.

The assistant, holding the transfer device, walks around to the back of the surgeon (in the direction shown by arrow in FIG. 9), passing his right side on the way, to the position shown in FIG. 10. If the assistant be a sterile person, he or she will be careful to take a "wide sweep" behind the surgeon (as shown in FIG. 10) thus precluding contact with the back of the surgeon. In the meantime, the surgeon transfers tie C from his left to his right hand. The assistant continues to walk around the surgeon, approaching a point at the left side of the surgeon's body. There the assistant stops and holds the transfer device in such a position that tie D is more or less extended and the surgeon then grasps tie D, the nurse still holding the far end of the transfer device (See FIG. 11). The assistant then pulls on the transfer device (phantom portion of FIG. 11) thus separating tie D, now held by the surgeon. The assistant discards the transfer device and the surgeon knots tie strings C and D near the point where tie C is attached to panel 24. Thus the knot is positioned quite near the side of the surgeon's body where it will not later interfere with the surgical procedure.

In a preferred aspect of the present invention, transfer device 60 is color-coded. This means that the transfer device has two colors which enable the wearer and/or his assistant to readily identify certain portions of the device. Referring to FIG. 4, shaded portion S of the device has a red color, and non-shaded portion N has a white color. The purpose of the red color is to identify that portion of the transfer device which, after tie string C has been removed therefrom by the surgeon as shown in FIG. 9, may be touched by a non-sterile assistant.

The area of the transfer device touched by a non-sterile assistant is thereafter contaminated. After the assistant has, by holding the red portion of the transfer device, brought tie string D around behind the surgeon and to his left side, the red coloring on portion S of the transfer device will serve to remind the surgeon that this portion of the device is contaminated and that he must not touch the same. Similarly, the non-sterile assistant will be careful to see that the red portion does not inadvertently touch the surgeon, the sterile surfaces of his operating apparel, or the like. It will be recognized that any two colors may be selected if it is desired to color code the transfer device. The colors selected should preferably be ones that contrast sharply with each other for additional ease of recognition. Red would seem to be preferred for portion S of the transfer device (portion S being that part of the device which releasably grasps tie string C and which the assistant will later touch) inasmuch as red is traditionally regarded as a warning of danger.

What is claimed is:

1. A surgical gown comprising a main sheet having sleeves attached thereto, said main sheet comprising a central panel and two side panels, said gown having outer belt means comprising two tie strings and a disposable belt engaging means, one end of one of said two tie strings being attached to the outer surface of said gown near the point where a first of said two side panels meets the central panel and one end of the other of said two tie strings being attached to the outer edge of the second of said two side panels, said belt engaging means being adapted to releasably grasp, and sequentially release, the free ends of said tie strings.

2. A surgical gown according to claim 1 which further includes inner closure means, said inner closure means comprising two tie strings, one end of one of said tie strings being attached near the outer edge of said first of said two side panels and one end of the other of said tie strings being attached to the inner surface of the gown near the point where said second of said two side panels joins said central panel.

3. A surgical gown according to claim 1 wherein said main sheet comprises a nonwoven fabric.

4. A surgical gown according to claim 3 wherein said nonwoven fabric is liquid-repellent.

5. A surgical gown according to claim 1 wherein said belt engaging means comprises a plastic.

6. A surgical gown according to claim 1 wherein said belt engaging means comprises paperboard.

7. A surgical gown according to claim 6 wherein the free ends of the ties comprising the outer belt means are releasably secured to said belt engaging means with a pressure sensitive adhesive.

8. A surgical gown according to claim 6 wherein the free ends of the tie strings comprising the outer belt means are releasably secured to said belt engaging means by gripping portions defined by slits cut through said belt engaging means.

9. A surgical gown according to claim 1 wherein said belt engaging means has contrasting colors.

10. A surgical gown according to claim 1 treated to render it sterile and packaged in said sterile condition.

11. A surgical gown according to claim 1 wherein said belt engaging means comprises a pair of spaced apart, cross-shaped slits disposed therein.

12. A surgical gown according to claim 1 wherein said belt engaging means comprises a pair of spaced apart, hook-shaped slits disposed therein.

13. A surgical gown according to claim 1 wherein said belt engaging means comprises four slits, the first two of said four slits running inwardly from a first edge of said belt engaging means and the remaining two of said four slits running inwardly from a second edge of said belt engaging means.

14. A surgical gown according to claim 13 wherein said first edge is parallel to said second edge and the distance between said remaining two slits is smaller than the distance between said first two slits, each of said first two slits being closer to the nearest edge of said belt engaging means to which it is positioned than is either of said second two slits.

15. A surgical gown according to claim 1 wherein said belt engaging means is generally H-shaped and comprises rectangular end portions joined by a cross-bar portion, said belt engaging means having slits in said rectangular end portions at the points where said end portions meet said cross-bar portion.

16. A surgical gown according to claim 1 wherein said belt engaging means comprises a pressure sensitive adhesive.

17. A surgical gown comprising a main sheet having sleeves attached thereto, said main sheet comprising a central panel and two side panels, said gown having outer belt means comprising two tie strings and a disposable belt engaging means, one end of one of said two tie strings being attached to the outer surface of said gown near the point where a first of said two side panels meets the central panel and one end of the other of said two tie strings being attached to the outer edge of the second of said two side panels, said belt engaging means comprising paperboard having contrasting colors and two spaced apart, cross-shaped slits, the free end of one of said two tie strings being threaded through one of said two slits and the free end of the other of said two tie strings being threaded through the other of said two slits, whereby the free ends of said tie strings are releasably secured to, and sequentially releasable from, said belt engaging means.

18. A surgical gown according to claim 17 wherein said main sheet comprises a nonwoven fabric and which further includes inner closure means, said inner closure means comprising two tie strings, one end of one of said tie strings being attached near the outer edge of said first of said two side panels and one end of the other of said tie strings being attached to the inner surface of the gown near the point where said second of said two side panels joins said central panel.

19. A surgical gown according to claim 16 treated to render it sterile and packaged in said sterile condition.

* * * * *